United States Patent [19]

Kaletta et al.

[11] Patent Number: 5,075,661

[45] Date of Patent: Dec. 24, 1991

[54] LOCKING DEVICE FOR A SWITCHING DEVICE WITH AN ELECTROMAGNETIC ACTUATOR

[75] Inventors: Joachim Kaletta; Ibrahim Traore; Reinhard Zeuke, all of Berlin, Fed. Rep. of Germany

[73] Assignee: Siemens Aktiengesellschaft, Berlin and Munich, Fed. Rep. of Germany

[21] Appl. No.: 477,987

[22] PCT Filed: Sep. 29, 1988

[86] PCT No.: PCT/DE88/00607

§ 371 Date: Apr. 26, 1990

§ 102(e) Date: Apr. 26, 1990

[87] PCT Pub. No.: WO89/04544

PCT Pub. Date: May 18, 1989

[30] Foreign Application Priority Data

Nov. 13, 1987 [DE] Fed. Rep. of Germany ..... 8715295

[51] Int. Cl.[5] ..... H01H 9/20

[52] U.S. Cl. ..... 335/166

[58] Field of Search ..... 335/21-23, 335/35, 59-64, 167-174

[56] References Cited

U.S. PATENT DOCUMENTS

| | | | |
|---|---|---|---|
| 3,249,716 | 5/1966 | Haydu et al. | 335/59 |
| 4,237,436 | 12/1980 | Setescak | 335/63 |
| 4,683,451 | 7/1987 | Grunert et al. | 335/174 |

FOREIGN PATENT DOCUMENTS

| | | |
|---|---|---|
| 1075557 | of 0000 | Fed. Rep. of Germany . |
| 1160930 | of 0000 | Fed. Rep. of Germany . |
| 3524526 | of 0000 | Fed. Rep. of Germany . |
| 8715295 | of 0000 | Fed. Rep. of Germany . |

*Primary Examiner*—Leo P. Picard
*Assistant Examiner*—Lincoln Donovan
*Attorney, Agent, or Firm*—Kenyon & Kenyon

[57] ABSTRACT

A locking device (6) which is provided in particular for vacuum contactors prevents an unintentional closing of the contact due to arbitrary mechanical influence as long as the electromagnetic actuator (1) is not excited. This takes place by means of a blocking lever (10), which is adjustably attached to a bearing block (7) between both of the parallel-mounted coils (3) of the actuator (1). A particularly rapid response of the blocking lever (10) is achieved by means of an acute-angled blade that sticks out, which is designed as an extension of the midsection (17) of the U- or C-shaped principal body of the blocking lever (10).

6 Claims, 2 Drawing Sheets

LOCKING DEVICE FOR A SWITCHING DEVICE WITH AN ELECTROMAGNETIC ACTUATOR

Figure 1:
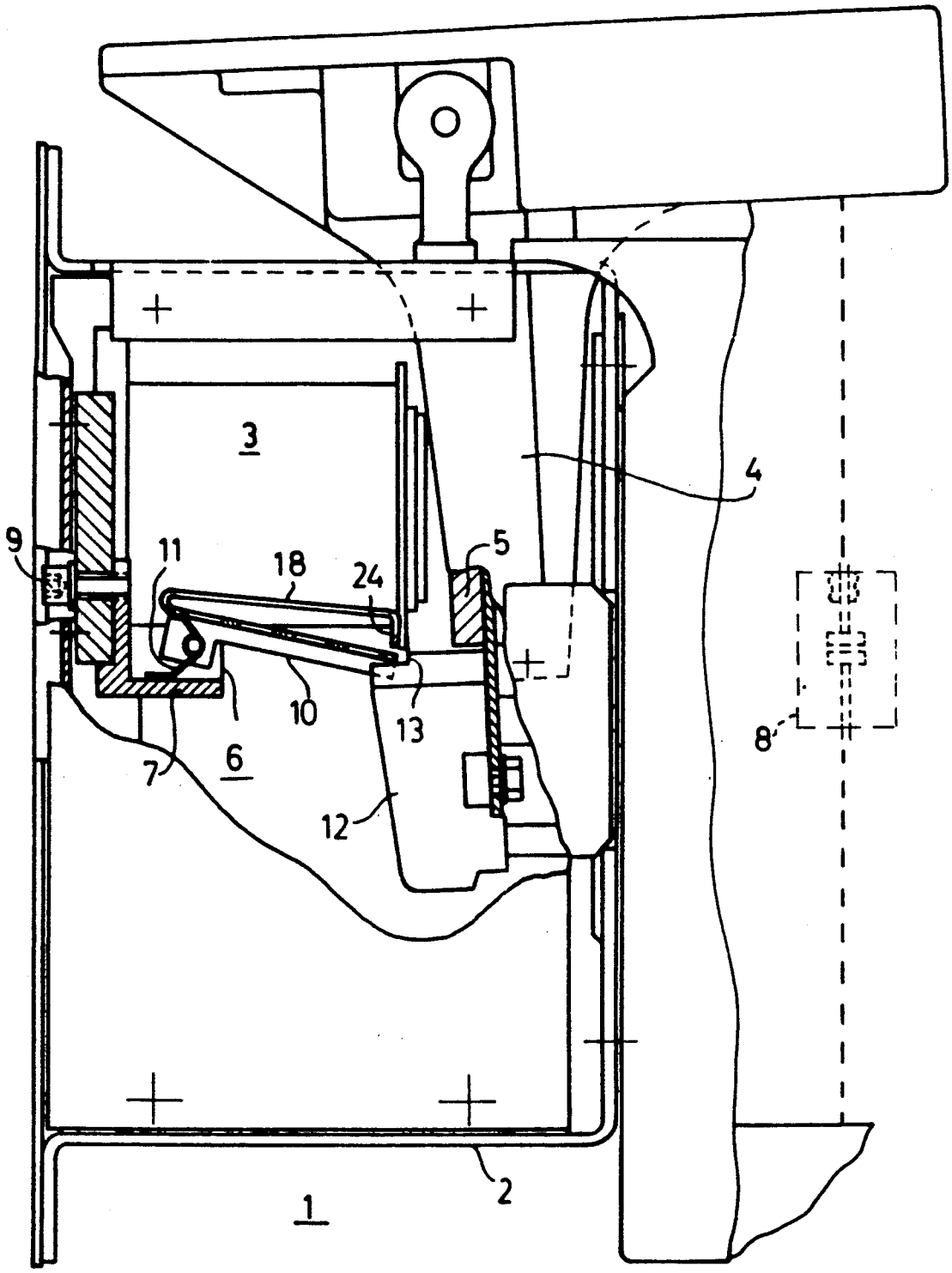

The invention concerns a locking device with a lever to block against the unintentional actuation of a switching device, in particular of a vacuum interrupter, with an electromagnetic actuator, whereby the blocking lever having two neighboring coils, which has a cross sectional shape approximating a U-shape, is adjustably supported within the interstitial space between the coils against the force of a reset spring, and, in the unexcited state of the electromagnetic actuator, [the blocking lever] is arranged with an end face opposite a working surface of a movable part of the electromagnetic actuator with a small clearance in proportion to the movable part of the electromagnetic actuator's working stroke, which recurs during the excitation of the coils.

A locking device of this type has become known through the teachings of DE-OS 35 24 526. For the faultless way of operating such a locking device it is necessary that, when the solenoid actuator is being closed, the blocking lever be quickly moved away from the working surface of the movable part of the solenoid actuator, e.g. of the movable armature, such that this movable part can perform unhindered the intended working stroke. As a rule, this condition is satisfied in that the motive resistance of the movable part of the solenoid actuator, together with the motive resistance of the switching points to be actuated, in particular of the vacuum interrupters, results in a speed of the sequence of movements which is considerably less than that of the blocking lever. By means of the invention, the known locking device is also able to be used in the case that the said motive resistance is considerably less, and, consequently, a hindrance of the normal closing of the switching device could occur by means of the blocking lever.

For this purpose, according to the invention, it is provided that the blocking lever carry an extension consisting of ferromagnetic material which extends into the interstitial space of the coil on the side of the blocking lever which is turned towards the coils of the electromagnetic actuator.

The extension is formed by an extension of the midsection of the U- or C-profile and is designed in one piece with the blocking lever as a blade which is arranged at an acute angle to the blocking lever and starting from the end of the blocking lever which neighbors the bearings.

An adaptation of the locking device to switching devices with a different motive resistance, e.g., which can arise through the use of vacuum interrupters with a lower power requirement, is now able to be achieved in quite a simple manner, since only the extension needs to be changed, e.g. by its angular positioning. The basic shape of the blocking lever and thus in particular the relative position of its end face and the working surface of the movable part of the electromagnetic actuator, which working surface interacts with this, can, in contrast, remain unchanged.

In the case of an electromagnetically actuated relay as a blocking device, it is already known (FR-A-1 075 557) how to provide a flexible blocking element, which is firmly affixed on one side, with an extension which extends laterally in the direction of the pole face of the relay, which has a blade consisting of ferromagnetic material on its end. The junction between the platespring-like section of the blocking element which extends approximately parallel to the coil, and the extension is designed as an acute-angled bend, which forms a stop face for the clapper-type armature of the relay. This kind of a flexible blocking element, however, is not suitable for blocking a stronger magnetic force as it occurs in a mechanical switching device for power circuitry of the aforesaid type, particularly in the case of a vacuum contactor. If, on the other hand, the flexible blocking element is equipped with a larger material cross section in order to magnify its supportive effect, then the motive resistance for the release of the closing operation increases. Therefore, a greater portion of the working magnetic flux of the electromagnetic actuator would have to be branched off for actuating the blocking device, and thus, this [electromagnetic actuator] would have to be more powerfully dimensioned. In contrast, the blade serving as an extension and being provided in the locking device according to the invention is located on an adjustably supported blocking lever and indirectly interacts with a pole face of the electromagnetic actuator. Rather, the extension better utilizes the magnetic flux, which is present in the interstitial space between the neighboring coils of the electromagnetic actuator, than the main body of the blocking lever is able due to its required positioning with reference to the movable part of the electromagnetic actuator which is being supported.

The blocking lever inclusive of the blade can consist of a magnetically soft sheet metal and can be provided with perforations to reduce the mass inertia. The quantity and size of the perforations also influence the speed of the movement of the blocking lever when the switching device is closed.

It has proved advantageous to apportion the length of the blade approximately according to the length of the midsection of the principal body of the blocking lever, since then the desired efficacy is present without substantially enlarging the dimensions.

The invention is more closely explained in the following in light of the exemplified embodiment which is represented in the figures.

According to the invention, in FIG. 1 the actuating device of a vacuum contactor with a blocking lever is shown in a side view in a simplified representation.

Figure 2:
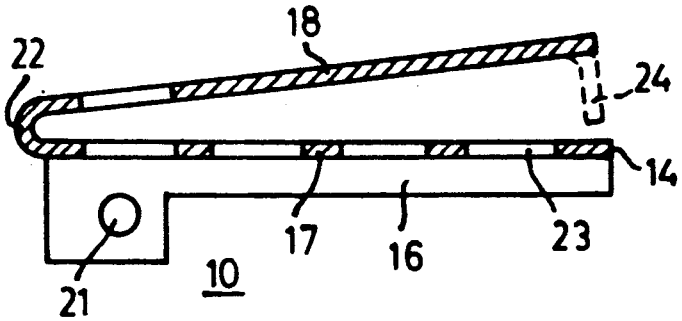
Figure 3:
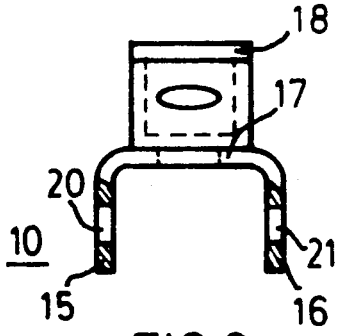
Figure 4:
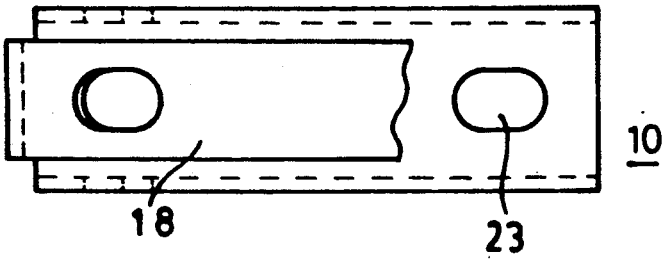

The FIGS. 2, 3 and 4 show the blocking lever as an individual part in three views which are perpendicular to each other.

According to FIG. 1, an electromagnetic actuating device 1 is placed in a box-shaped frame 2 and has two coils 3. Both of the coils 3 are arranged next to each other in the manner which is represented in DE-OS 35 24 526. A lever 4 provided with an armature 5 is able to perform a swiveling motion traveling clockwise when the coils 3 are excited, which swiveling motion serves to actuate the vacuum interrupters, of which one is schematically indicated and marked with 8. In order to avoid unintentionally closing the vacuum interrupters due to an arbitrary mechanical effect on the switching device as long as the coils 3 are not excited, a locking device 6 is provided which is arranged between both of the coils 3 as a cohesive module. The locking device 6 primarily consists of a bearing block 7, a blocking lever 10 as well as a reset spring 11 Attached to the lever 4 is a blocking element 12 which, with a working surface 13, stands opposite an end face 14 (FIG. 2) of the blocking lever 10 with a small clearance. The locking device 6 is secured as a unit by means of at least one screw 9 to the yoke of the coils 3.

In the case of a normal closing of the switching device, the coils 3 are excited, whereby a force is simultaneously exerted on the lever 4 and the blocking lever 10. However, since the blocking lever responds more quickly to the magnetic field of the coils 3 due to its special design, the end face 14 of the blocking lever 10 is moved away from the working surface 13 of the blocking element 12 before the actuating lever is set into motion.

Details of the blocking lever 10 are explained in the following in light of the FIGS. 2, 3 and.

As FIG. 3 shows in particular, the blocking lever 10 has a principal body with a cross-sectional shape approximating a U- or C-shape with lateral sides 15 and 16 as well as with a midsection 17. A blade 18 extends from the midsection 17 of the principal body, indeed from that very end on which bearing openings 20 and 21 are provided in the lateral sides 15 and 16 for the fully adjustable positioning on the bearing block 6, which is shown in FIG. 1. Starting from a bending radius 22 which is suitable for fabrication, the blade 18 thereby stands at an acute angle to the midsection 17.

The blade 18 extends even further into the interstitial space between the coils 3 and is therefore more strongly subject to the magnetic field which exists there than the principal body of the blocking lever with the midsection 17 and the lateral sides 15 and 16. In this manner, the blocking lever 10 is swivelled particularly rapidly.

As the FIGS. 2 and 4 show, the midsection 17 of the blocking lever includes perforations 23 whose shape and quantity can be selected such that the mass inertia of the blocking lever 10 is reduced and by this means the desired rapid responsive action is achieved. The blocking lever 10 can be made in one piece from magnetically soft sheet metal and requires only a few processing steps. Therefore, the angle between the blade 18 and the midsection 17 can also be appropriately selected in order to also influence the responsive action.

A bent-down tail (24) of the blade 18 is shown by a dotted line in FIG. 2 as it is also represented in the example according to FIG. 1. The length and positioning of this tail 24 limit the bending path of the blade 18 opposite the midsection 17 so that no undesirable deformations take place.

We claim:

1. A locking device with a blocking lever to block against unintentional actuation of a switching device, in particular of a vacuum contactor, with an electromagnetic actuator which has two neighboring coils wherein the blocking lever, which has a cross-section shape approximating a U- or C-shape and has bearing openings adjacent one end of a principal body of the blocking lever, is adjustably supported within an interstitial space between the coils against the force of a reset spring and, in the unexcited state of the electromagnetic actuator, said blocking lever is arranged with an end face opposite a working surface of a movable part of the electromagnetic actuator with a small clearance in proportion to a movable part of the electromagnetic actuator's working stroke, wherein the working stroke occurs during the excitation of the coils, characterized in that the blocking lever carries an extension consisting of ferromagnetic material, which extends into the interstitial space of the coils, on the blocking lever side which is turned towards the coils of the electromagnetic actuator, said extension being formed by an extension of the midsection of the U- or C-profile and being designed in one piece with the blocking lever as a blade which is arranged at an acute angle to said blocking lever and starting from the end of said blocking lever which neighbors said bearing openings.

2. The locking device according to claim 1 wherein the blocking lever (10) inclusive of the blade (18) includes of magnetically soft sheet metal and is provided with perforations (23) to reduce the mass inertia.

3. The locking device according to claim 1, wherein the blade (18) is provided on its free end with a bend (24) which extends in the direction of the principal body of the blocking lever (10).

4. The locking device according to claim 2 wherein the blade is provided on its free end with a bend which extends in the direction of the principal body of the blocking lever.

5. The locking device according to claim 3, wherein the length of the blade is apportioned approximately according to the length of the midsection of the principal body of the blocking lever.

6. The locking device according to claim 4, wherein the length of the blade is apportioned approximately according to the length of the midsection of the principal body of the blocking lever.

* * * * *